US005895039A

United States Patent [19]

Kato et al.

[11] Patent Number: 5,895,039

[45] Date of Patent: Apr. 20, 1999

[54] SHEET-SUPPLY DEVICE

[75] Inventors: Hiroyuki Kato; Fumikazu Sato, both of Nagoya, Japan

[73] Assignee: Brother Kogyo Kabushiki Kaisha, Nagoya, Japan

[21] Appl. No.: 08/823,203

[22] Filed: Mar. 24, 1997

[30] Foreign Application Priority Data

Mar. 29, 1996 [JP] Japan ..... 8-077052

[51] Int. Cl.[6] ..... B65H 3/52

[52] U.S. Cl. ..... 271/124; 271/119; 271/121; 271/127

[58] Field of Search ..... 271/119, 120, 271/121, 124, 127, 167

[56] References Cited

U.S. PATENT DOCUMENTS 5,026,042 6/1991 Miller .
5,348,283 9/1994 Yanagi et al. ..... 271/127
5,527,029 6/1996 Bortolotti et al. ..... 271/124
5,582,399 12/1996 Sugiura ..... 271/120
5,697,603 12/1997 Kato ..... 271/119

FOREIGN PATENT DOCUMENTS 2-132018 5/1990 Japan .

*Primary Examiner*—H. Grant Skaggs
*Attorney, Agent, or Firm*—Oliff & Berridge, PLC

[57] ABSTRACT

A sheet-feed device including: a hopper having a surface on which sheets are stacked; at least one sheet-feed roller for abutting a surface of an uppermost sheet of the sheets so that rotation of the at least one sheet-feed roller feeds the uppermost sheet in a sheet-feed direction; a wall portion formed at a front edge, with respect to the sheet-feed direction, of the hopper, the wall portion including: a slanting surface gradually slanting in the sheet-feed direction with increasing distance from the surface of the hopper; and an indentation portion formed at a position corresponding to position of the at least one sheet-feed roller and receded away from the slanting surface in the sheet-feed direction.

16 Claims, 3 Drawing Sheets

SHEET-SUPPLY DEVICE

BACKGROUND OF THE INVENTION

1. Field of the Invention

The present invention relates to a sheet-feed device for using sheet-feed rollers to feed one sheet at a time from a stack of sheets in a hopper.

2. Description of the Related Art

Japanese Laid-Open Patent Application No. HEI-2-132018 and U.S. Pat. No. 5,026,042 describe a sheet-supply device used in a printer. The sheet-supply device includes a hopper filled with a stack of sheets, a sheet-feed roller, and a slanting surface connected with the hopper. The sheet-feed roller rotates while in abutment with the surface of the uppermost sheet stacked in the hopper, thereby feeding out the sheet in a predetermined direction toward the slanting surface. When the front edge of the fed-out sheet abuts against the slanting surface, the sheet will bend and be separated away from the other sheets in the stack. The sheet is then transported toward a predetermined position out of the hopper, such as towards a printing region.

SUMMARY OF THE INVENTION

However, with this type of sheet-supply device, when rotation of the sheet-feed roller moves more than one sheet at a time, the force of the sheet-feed roller can strongly press the sheets against the slanting surface, so that the sheets are fed out of the hopper without separating from each other. Feeding out more than one sheet at a time in this manner will be referred to as redundant sheet feed hereinafter.

It is an objective of the present invention to provide a sheet-supply device capable of properly separating sheets one at a time from a stack in a hopper.

In order to achieve the above-described objectives, a sheet-feed device according to the present invention includes: a hopper having a surface on which sheets are stacked; at least one sheet-feed roller for abutting a surface of an uppermost sheet of the sheets so that rotation of the at least one sheet-feed roller feeds the uppermost sheet in a sheet-feed direction; a wall portion formed at a front edge, with respect to the sheet-feed direction, of the hopper, the wall portion including: a slanting surface gradually slanting in the sheet-feed direction with increasing distance from the surface of the hopper; and an indentation portion formed at a position corresponding to position of the at least one sheet-feed roller and receded away from the slanting surface in the sheet-feed direction.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
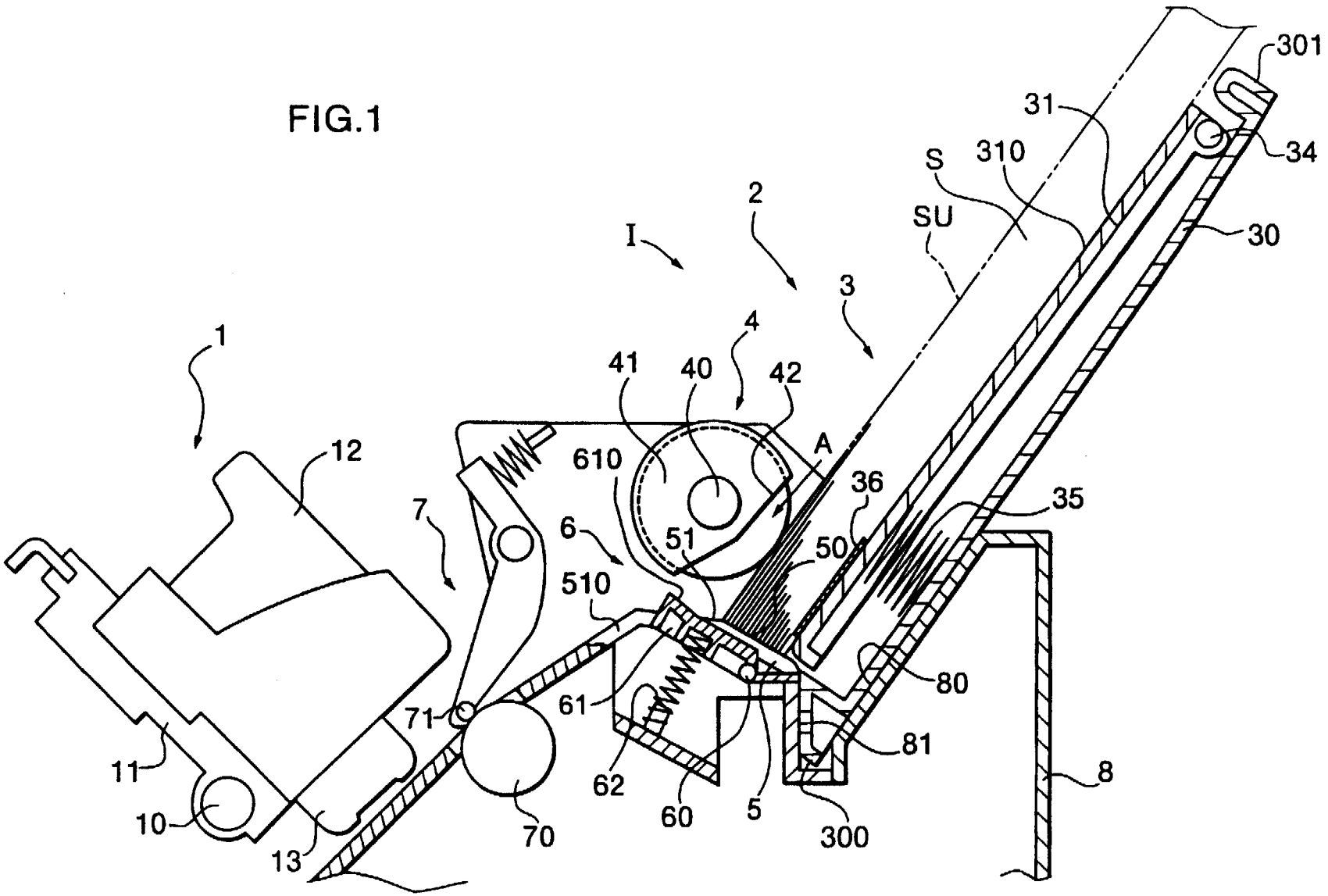
FIG. 1 is a side view in partial cross section showing a sheet-supply device according to the present invention.

A sheet-supply device according to a preferred embodiment of the present invention will be described while referring to the accompanying drawings wherein like parts and components are designated by the same reference numerals to avoid duplicating description.

As shown in FIG. 1, an ink jet printer according to the present embodiment includes: a print mechanism 1 for performing predetermined printing operations on a sheet; and a sheet-supply device 2 for supplying one sheet SU at a time from a stack of sheets S to the print mechanism 1. The sheets S are cut sheets, which are each formed in a rectangular shape with fixed dimensions.

The print mechanism 1 includes: a guide rail 10; a carriage 11 reciprocally movable following the guide rail 10; and a print head 13 supported with an ink cartridge 12 on the carriage 11. The guide rail 10 is disposed extending in a direction parallel to the surface of the sheets S and orthogonal to a sheet-feed direction of the sheet SU supplied from the sheet-supply device 2. Although the sheet-feed direction of the sheet SU changes as the sheet SU is fed toward the print mechanism 1, it will be assumed that, unless otherwise noted, the sheet-feed direction will refer to the direction of a sheet SU supplied from a hopper 3 as represented by an arrow A in FIG. 1.

While the carriage 11 is reciprocally driven by a drive source, such as a motor not shown in the drawings, the print head ejects ink droplets towards the sheet SU passing therebeneath, thereby printing characters and figures on the sheet SU.

The sheet-supply device 2 includes: the hopper 3 containing stacked sheets S including an uppermost sheet SU; a sheet-feed mechanism 4 for feeding the sheet SU from the hopper 3; a wall portion 5 where sheets S stacked in the hopper 3 abut in the sheet-feed direction; a stopper mechanism 6 provided on the wall portion 5; and a transport mechanism 7 for transporting the sheet SU directly beneath the print head 13. The transport mechanism 7 is positioned downstream in the sheet-feed direction from the wall portion 5.

Figure 2:
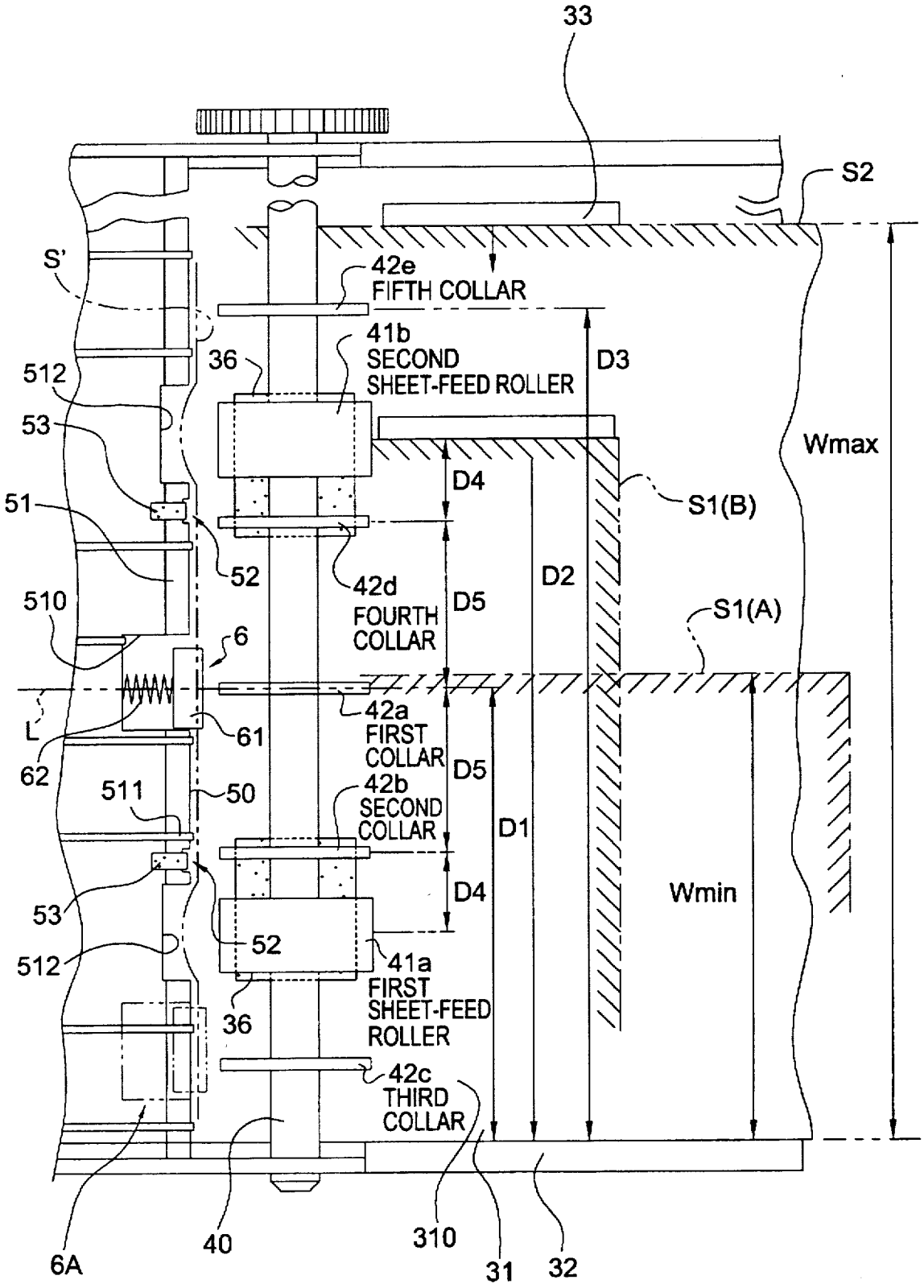
FIG. 2 is a plan view showing the sheet-supply device of FIG. 1.

The hopper 3 includes a sheet cassette 30, which is detachable with respect to the printer. Cassette receiving surfaces 80, 81 formed in a print frame 8 support the sheet cassette 30 at its front edge 300 near the discharge edge of the sheets S so that the sheet cassette 30 tilts at an angle. A pressing-up plate 31 is provided to the interior of the sheet-supply cassette 30. Sheets S are stacked at the upper surface 310 of the pressing-up plate 31. As shown in FIG. 2, a pair of sheet guides 32, 33 for sandwiching the sheet in the vertical direction of FIG. 2 are provided near opposite edges of the pressing-up plate 31. The first sheet guide 32 is fixed in place and the second sheet guide 33 is freely movable in the vertical direction of FIG. 2 so that the first and second guides 32, 33 can sandwich a variety of different sheets with different dimensions therebetween.

First, sheets stacked on the pressing-up plate 31 are aligned so that one edge is aligned parallel with the sheet-feed direction by abutting the edge against the first sheet guide 32. Then, the sheets aligned against the first sheet guide 32 are pressed from the opposite edge by the second sheet guide 33. Accordingly, sheets S contained in the hopper 3 are supported at a fixed position at the side abutted by the first sheet guide 32 regardless of the width of the sheet.

As shown in FIG. 1, the pressing-up plate 31 is pivotably rotatable around a pivot shaft 34 provided at the upper edge 301 of the sheet-supply cassette 30. A spring 35 is provided for urging the pressing-up plate 31 toward the sheet-feed mechanism 4. With this configuration, the pressing-up plate 31 is pressed toward the sheet-feed mechanism 4 with an increasing large stroke with proximity of the pressing-up plate 31 to the wall portion 5. In this way, the front edge of the sheet SU can be strongly pressed against a pair of sheet-feed rollers 41*a*, 41*b* of the sheet-feed mechanism 4. It should be noted that the pivot shaft 34 is disposed so as to extend perpendicular to the sheet-feed direction and parallel with the surface of the sheets S. The pressing-up plate 31 is formed from, for example, a resin material and has a relatively small coefficient of friction at its exposed upper surface 310. Accordingly, friction resistance between the lowest sheet in the hopper 3 and the upper surface 310 of the pressing-up plate 31 is smaller than friction resistance between the stacked sheets S. Therefore, when only a few sheets, for example two or three sheets, remain in the hopper, there is a danger that all of the remaining sheets S will slide over the upper surface 310 of the pressing-up plate 31 and be fed out at the same time. To prevent the lowest sheet in the hopper 3 from being drawn out with the uppermost sheet SU in this case, a friction member 36 is attached to the upper surface 310 of the pressing-up plate 31. The friction members 36 can be made of, for example, cork.

As shown in FIGS. 1 and 2, the sheet-feed mechanism 4 includes: a support shaft 40 extending perpendicular to the sheet-feed direction and parallel with the surface of the sheets S; the pair of sheet-feed rollers 41*a*, 41*b* attached to the support shaft 40 and separated by a predetermined distance; and five collars 42*a*, 42*b*, 42*c*, 42*d*, and 42*e* rotatably provided on the support shaft 40 and separated by predetermined distances. The sheet-feed rollers 41*a*, 41*b* will be referred to collectively as the sheet-feed rollers 41 when there is no need to distinguish between them. Similarly, the collars 42*a* through 42*e* will be referred to collectively as the collars 42 when there is no need to distinguish between them.

The support shaft 40 is rotatable in both counterclockwise and clockwise directions as viewed in FIG. 1 by a drive source (not shown in the drawings). The sheet-feed rollers 41 are formed in a substantially half-moon shape and are integrally rotatable with the support shaft 40. Although not shown in the drawings, a friction member formed from rubber, for example, for increasing the coefficient of friction of the sheet-feed rollers 41 is provided covering the outer periphery of the sheet-feed rollers 41.

The collars 42 are formed in a circular disk shape and are provided freely rotatable with respect to the support shaft 40. The collars 42 are formed with a radius slightly smaller than a maximum radius of the sheet-feed rollers 41, that is, including the friction member of the sheet-feed rollers 41. With this configuration, when the support shaft 40 rotates in the clockwise direction (as viewed in FIG. 1) until the outer periphery of the circular portion of the sheet-feed rollers 41 confronts the hopper 3, then the uppermost sheet SU, which is pressed upward out of the hopper 3 by the pressing-up plate 31, will be pressed against the circular portion of the sheet-feed rollers 41. As rotation of the sheet-feed rollers 41 continues, the uppermost sheet SU will be fed out of the hopper 3. Further rotation of the sheet-feed rollers 41 will bring the flat portion of the sheet-feed rollers 41 into confrontation with the hopper 3 so that the portion of the sheet SU still remaining in the hopper 3, that is, the portion of the uppermost sheet SU not yet fed out by the circular portion, will abut against the outer peripheral surface of the collars 42. With this configuration, after the sheet-feed rollers 41 complete separation and feed of the sheet SU, the collars 42 will maintain a distance between the sheet-feed rollers 41 and the sheet being fed out while rotating in association with movement of the sheet SU as the sheet SU is transported by the transport mechanism 7. In this way, the sheets S stacked in the hopper 3 can be prevented from lifting up until feed of the next sheet SU is started. As a result, redundant sheet feed, that is, the problem of more than one sheet being fed at a time which is caused by sheets S lifting up, can be prevented.

As shown in FIG. 2, the collars 42 include: a first collar 42*a* disposed at a position centered on an imaginary line L between the pair of sheet-feed rollers 41; a second collar 42*b* disposed at a position between the first collar 42*a* and the first sheet-feed roller 41*a*, which is nearer to the first sheet guide 32 than the second sheet-feed roller 41*b*; a third collar 42*c* disposed nearer to the first sheet guide 32 than is the first sheet-feed roller 41*a*, that is, disposed between the first sheet guide 32 and the first sheet-feed roller 41*a*; a fourth collar 42*d* disposed between the first collar 42*a* and the second sheet-feed roller 41*b*, which is further from the first sheet guide 32 than is the first sheet-feed roller 41*a*; and a fifth collar 42*e* disposed further from the first sheet guide 32 than is the second sheet-feed roller 41*b*.

For this reason, the number of the sheet-feed rollers 41*a*, 41*b* and of the collars 42*a* to 42*e* that come into contact with the sheet S will vary with the width of the sheet S presently in abutment with the sheet guide 32. An example of the sheet S1 shown in FIG. 2 includes a 100 mm by 148 mm postcard. Examples of the sheet S2 include a 210 mm by 297 mm A4 sheet and a 216 mm by 279 mm letter sheet.

Further, one of the two friction members 36 of the pressing-up plate 31 is provided at a region confronting the first sheet-feed roller 41*a* and the third collar 42*c* and the other at a region confronting the second sheet-feed roller 41*b* and the fourth collar 42*d*. The urging force of the spring 35 presses the pressing-up plate 31 in a linear direction in which the friction members 36 are aligned with corresponding ones of the sheet-feed rollers 41*a*, 41*b* and the collars 42*b*, 42*d*. This increases the separating effects of the friction member 36 against the sheet SU.

As shown in FIG. 1, the wall portion 5 is integrally formed with the printer frame 8. As shown in detail in FIG. 3, a sheet receiving surface 50 and a slanting surface 51 are formed in the wall portion 5. The sheet receiving surface 50 receives and stops sheets S when a user stacks the sheets S in the hopper 3 from the upper edge of the sheet-supply cassette 30. The slanting surface 51 slants in the direction in which the sheets S are to be fed when separated away from the sheet-supply cassette 30. Sheets S pass around the wall portion 5 when fed out of the sheet-supply cassette 30 toward the transport mechanism 7. It should be noted that in order to reduce friction, the slanting surface 51 could be formed in a curved shape and provided with protrusion portions 511 extending along the surface of the slanting surface 51 in the direction in which sheets S are to be fed.

Figure 3:
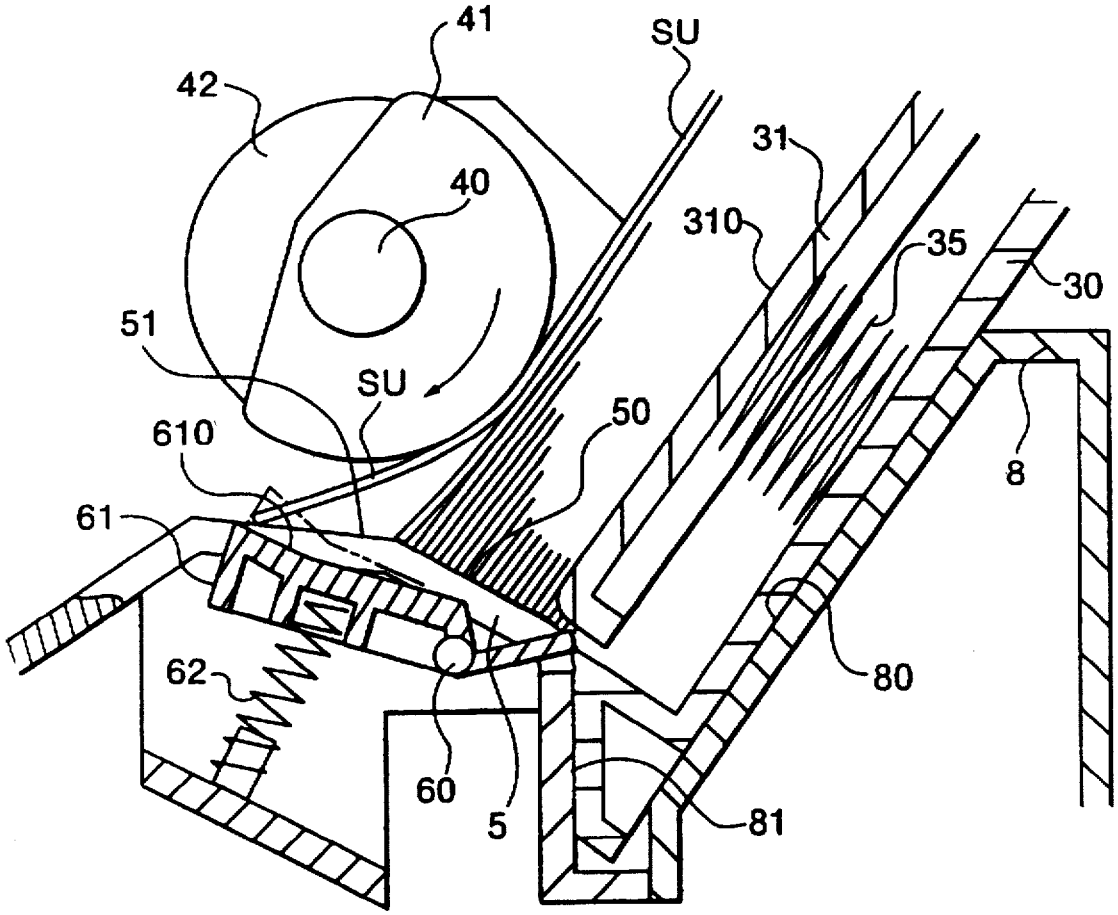
FIG. 3 is an enlarged view of FIG. 1 showing essential portions of the sheet-supply device.

As shown in FIG. 2, a cut-out hole 510 is provided in the slanting surface 51. As shown in FIG. 1, stopper mechanism 6 is disposed within the cut-out hole 510. The stopper mechanism 6 includes: a pivotal shaft 60, a stopper 61 pivotably supported on the pivotal shaft 60, and a coil spring 62 urging the stopper 61 toward the hopper 3. The rotational shaft 60 is provided at the base of the hopper 3 so as to extend perpendicular to the sheet-feed direction and parallel to the surface of the sheets S. The stopper 61 pivots around the pivotal shaft 60 so as to protrude from the slanting surface 51 toward the first collar 42*a* and recede beneath the slanting surface 51 away from the first collar 42*a*. The rotational shaft 60 and the coil spring 62 are supported on the frame 8. In FIG. 3, the condition of the stopper 61 when protruding away from the slanting surface 51 is indicated by a two-dot chain line and the condition of the stopper 61 when receding below the slanting surface 51 in a solid line. The stopper 61 is formed from the same resin material as the printer frame 8 and is formed with a resiliency and a stiffness sufficiently high enough to maintain a fixed form against the pressing force of the sheets S when the sheets S abut against a contact surface 610. Also, as shown in FIG. 2, the stopper 61 is disposed centered on the central line L between the pair of sheet-feed rollers 41 with respect to an axial direction of the support shaft 40. As indicated by a two-dot chain line in FIG. 2, an additional stopper mechanism 6A can be provided between the first sheet-feed roller 41*a* and the first sheet guide 32.

As shown in FIG. 3, the sheet SU fed out from the sheet-supply cassette 30 first abuts and presses against the contact surface 610 of the stopper 61, then passes over the stopper 61 before traveling towards the transport mechanism 7. The amount that the stopper 61 is pressed by the sheet SU varies with the resiliency and stiffness of the sheet SU. For example, when the sheet SU is a post card, an envelope, or other thick and highly resilient sheet, the stopper 61 is pressed almost flush with the slanting surface 51. As a result, the sheet SU is fed while following the curved surface of the slanting surface 51. Because the slanting surface 51 has a small gradient, the sheet SU will slide over it with little resistance. Therefore, there is little danger of the sheet SU sticking to the slanting surface 51, and of the sheet-feed rollers 41 rotatingly sliding over the surface of the sheet SU without transporting it as a result. On the other hand, when the sheet SU is thin and therefore has slight resiliency, the spring 62 is barely compressed by the resiliency of the sheets. The sheet SU will therefore greatly bend at its front edge when it abuts against the stopper 61. This enhances separation between the sheet SU and the other sheets S. To prevent sliding rotation of the sheet-feed rollers 41 over the sheet SU, it is desirable that the friction force operating between the sheet-feed rollers 41 and the sheet SU be greater than the friction force between the sheet SU and the stopper 61.

As shown in FIG. 2, indentation portions 512 are formed in the slanting surface 51 at positions corresponding to the sheet-feed rollers 41 with respect to the sheet feed direction of the sheet SU. As shown by a dotted-chain line S' in FIG. 2, the front edge portion of the sheet SU pressed by the sheet-feed rollers 41 is deformed so as to bend into the indentation portions 512 and, at the substantial central position between the indentation portions 512, also in the opposite direction by the stopper 61. Separation of the sheet SU from the other sheets S is improved with this configuration.

In devices wherein a surface of the hopper slants downward in the sheet-feed direction of sheets, the sheet-feed force of the sheet-feed roller acting on each sheet is added to the self weight of the sheet, so that redundant sheet feed can easily occur. However, with the configuration according to the present invention, a portion of the front edge of the sheet S bends into the indentation portion 512 so that sheets S can be prevented from remaining stacked on each other when sliding down the slanting surface. Although the indentation portion 512 is described above as having a width slightly greater than the width of the sheet-supply roller 41, it could be formed with a width equal to or less than the width of the sheet-feed roller 41 instead.

A pair of groove portions 52 are formed in the wall portion 5 and aligned with the stopper 61 in the axial direction of the support shaft 40. A friction member 53 is adhered to each groove portion 52. The friction members 53 protrude from the groove portion 52 in the sheet feed direction so as to be exposed above the slanting surface 51. The friction members 53 increase the coefficient of friction at the slanting surface 51 to greater than the coefficient of friction at the contact surface of the stopper 61. With this configuration, the sheet SU will slide across stopper 61 more easily than across the slanting surface 51 so that separation of the sheet SU from the other sheets S at the slanting surface 51 is improved.

The sheet SU, after passing the over the wall portion 5, is guided between the transport roller 70 and the slave roller 71 of the transport mechanism 7. However, before the sheet SU reaches the transport roller 70, as viewed in FIG. 2, clockwise rotation of the transport roller 70 is continued until the sheet SU is fed out a predetermined distance by the sheet-feed rollers 41. Then the transport roller 70 is driven to rotate in the counterclockwise direction as viewed in FIG. 2. In this way, the front edge of the sheet SU abuts against the transport roller 70 and is aligned in the axial direction of the transport roller 70 before being transported to the print mechanism 1.

With the configuration described above, the uppermost sheet US receiving the rotational force of the sheet-feed roller 41 deforms so as to bend into the indentation portions 512 as indicated by the imaginary two-dot chain line S' in FIG. 2 so that separation between sheets is improved. Therefore, a superior sheet-supply device capable of preventing redundant sheet feed can be provided.

While the uppermost sheet US receiving the rotational force of the sheet-feed roller 41 bends into the indentation portions 512, the stopper 61 presses the sheet S to also bend in the opposite direction at a position between the indentation portions 512. In other words, the front edge of the uppermost sheet US pressed against the slanting surface is deformed by pressure from both surfaces, that is, by the sheet-feed roller 41 pressing the sheet US into the indentation portion 512 from one surface and the stopper 61 pressing against the opposite surface. As a result, separation of sheets is even further improved.

When the sheet S slants within the hopper 3 in the manner described above, the self weight of an uppermost sheet US can cause the uppermost sheet S to stick to the next sheet S in the stack, thereby resulting in redundant sheet feed. However, when the indentation portion 512 is formed in the slanting surface 51, the sheet S increasingly deforms at the indentation portion 512 in accordance with increase in the self weight of the sheet S, thereby insuring proper separation of the sheets S. Therefore, separation of sheets is uninfluenced by the self weight of the sheets, thereby insuring reliable separation of the sheets.

When the sheet-supply device according to the present invention is used in an ink jet printer, printing misses caused by improper sheet feed can be reduced so that the printer is more reliable.

While the invention has been described in detail with reference to specific embodiments thereof, it would be apparent to those skilled in the art that various changes and modifications may be made therein without departing from the spirit of the invention, the scope of which is defined by the attached claims.

For example, only one or more than two sheet-feed rollers 41 can be provided. In this case, the number of indentation portions 512 can be changed to match the number sheet-feed rollers 41. When three or more sheet-feed rollers 41 are provided, then as long as indentation portions 512 are provided at positions corresponding to at least one pair of the sheet-feed rollers 41 and a stopper 61 is disposed between the indentation portions 512, then the sheet S can be deformed as indicated by the imaginary two-dot-chain line S' in FIG. 2. The stopper 612 can be formed from rubber or other resilient material that is somewhat deformed by pressing force of the sheet S. Also, the stopper 61 can be omitted completely.

The present invention can be applied to a sheet-supply device wherein the sheet guides 32, 33 of the sheet-feed cassette 30 are linked to move away from and toward each other together symmetrically in a direction perpendicular to the sheet-feed direction so that the central line of the sheets S is aligned with the central line of the hopper 3 regardless of the width of the sheet.

The sheet-supply device of the present invention is not limited to use in an ink jet printer, but can be used in any print device, such as a laser printer or other types of printers, copy machines or facsimile machines. The present invention can also be applied to a sheet-supply device which supports sheets in a horizontal posture rather than in a vertical posture.

What is claimed is:

1. A sheet-feed device comprising:

a hopper having a surface on which sheets are stacked;

at least one sheet-feed roller for abutting a surface of an uppermost sheet of the sheets so that rotation of the at least one sheet-feed roller feeds the uppermost sheet in a sheet-feed direction;

a wall portion formed at a front edge, with respect to the sheet-feed direction, of the hopper, the wall portion including:

a slanting surface gradually slanting with respect to the sheet-feed direction with increasing distance from the surface of the hopper; and an indentation portion formed in the slanting surface at a position corresponding to a position of the at least one sheet-feed roller and receded away from the slanting surface in the sheet-feed direction, the indentation portion defined by opposing walls extending from the slanting surface and a base adjoining each of the walls, the base in direct confrontation with at least one of the at least one sheet-feed roller and a sheet fed out by the at least one sheet-feed roller;

wherein a sheet fed out by the at least one sheet-feed roller is deformable into the indentation portion in an unobstructed manner.

2. A sheet-feed device as claimed in claim 1, wherein the at least one sheet-feed roller includes a first sheet-feed roller and a second sheet-feed roller separated in a direction perpendicular to the sheet-feed direction.

3. A sheet-feed device as claimed in claim 2, wherein the wall portion further includes a stopper portion positioned between the first sheet-feed roller and the second sheet-feed roller with respect to the direction perpendicular to the sheet-feed direction.

4. A sheet-feed device as claimed in claim 3, wherein the stopper portion is movable between a first position protruding above the slanting surface in a direction opposite the sheet-feed direction and a second position receded below the slanting surface in the sheet-feed direction, the stopper portion moving into the first position and the second position depending on resiliency of the sheet abutting thereagainst.

5. A sheet-feed device as claimed in claim 4, further comprising an urging means for urging the stopper portion into the first position and producing an urging force greater than resiliency of a first sheet type usable in the sheet-feed device and less than resiliency of a second sheet type usable in the sheet-feed device.

6. A sheet-supply device as claimed in claim 2, further comprising:

a sheet guide provided to the hopper and for aligning a side of the sheets into alignment with the sheet-feed direction, the first sheet-feed roller being disposed nearer the sheet guide than is the second sheet-feed roller; and a first, second, and third collar, the first collar being positioned substantially centered between the first sheet-feed roller and the second sheet-feed roller, the second collar being disposed between the first collar and the first sheet-feed roller, and the third collar being disposed nearer the sheet guide than is the first sheet-feed roller.

7. A sheet-supply device as claimed in claim 6, further comprising:

a fourth collar disposed between the second sheet-feed roller and the first collar; and a fifth collar disposed further from the sheet guide than is the second sheet-feed roller.

8. A sheet-supply device as claimed in claim 7, further comprising:

an upward pressing plate configuring the surface of the hopper and for pressing the uppermost sheet toward the sheet-feed rollers; and a means for increasing coefficient of friction between the uppermost sheet and the upward pressing plate, the means being disposed at a first region corresponding to the second collar and the first sheet-feed roller and at a second region corresponding to the second sheet-feed roller and the fourth collar.

9. A sheet-supply device as claimed in claim 6, further comprising a print head disposed downstream from the sheet-supply device with regards to a sheet feed direction and for ejecting ink droplets toward the sheet.

10. A sheet-feed device as claimed in claim 6, wherein the wall portion further includes a stopper portion positioned between the first sheet-feed roller and the second sheet-feed roller with respect to the direction perpendicular to the sheet-feed direction, the stopper portion being movable between a first position protruding above the slanting surface in a direction opposite the sheet-feed direction and a second position receded below the slanting surface in the sheet-feed direction, the stopper portion moving into the first position and the second position depending on resiliency of the sheet abutting thereagainst.

11. A sheet-supply device as claimed in claim 10, further comprising an additional stopper provided between the first sheet-feed roller and the sheet guide.

12. A sheet-feed device as claimed in claim 1, wherein the hopper is configured so that the surface is movable in a direction in which the sheets are stacked thereon, the surface being movable to a gradually greater stroke the nearer the surface is to the wall portion.

13. A sheet-feed device as claimed in claim 12, wherein the hopper includes:

a pivot shaft disposed at a rear edge of the hopper opposite the front edge;

a pressing-up plate forming the surface of the hopper and pivotally disposed on the pivot shaft; and an urging means for urging the pressing plate to pivot in the direction in which the sheets are stacked and toward the at least one sheet-feed roller.

14. A sheet-supply device as claimed in claim 1, further comprising a print head disposed downstream from the sheet-supply device with regards to the sheet feed direction and for ejecting ink droplets toward the sheet.

15. A sheet-supply device as claimed in claim 1, wherein the indentation portion is formed to a width wider than a width of the at least one sheet-feed roller.

16. A sheet-supply device as claimed in claim 1, further comprising a rotational shaft disposed in confrontation with the hopper;

wherein the at least one sheet-feed roller includes a pair of sheet-feed rollers disposed on the rotational shaft; and further comprising a plurality of collars freely rotatable around the rotational shaft and disposed between the sheet-feed rollers and nearer the sheet-feed rollers than to each other.

* * * * *